US011543162B2

(12) United States Patent
Zhang et al.

(10) Patent No.: US 11,543,162 B2
(45) Date of Patent: Jan. 3, 2023

(54) CIRCULATION SYSTEM OF AIR CONDITIONER, AIR CONDITIONER, AND AIR CONDITIONER CONTROL METHOD

(71) Applicant: GREE ELECTRIC APPLIANCES, INC. OF ZHUHAI, Zhuhai (CN)

(72) Inventors: Longai Zhang, Zhuhai (CN); Chuanhua Wang, Zhuhai (CN); Qiu He, Zhuhai (CN); Si Sun, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 332 days.

(21) Appl. No.: 16/960,075

(22) PCT Filed: Dec. 14, 2018

(86) PCT No.: PCT/CN2018/121183

§ 371 (c)(1),
(2) Date: Jul. 4, 2020

(87) PCT Pub. No.: WO2019/134492

PCT Pub. Date: Jul. 11, 2019

(65) Prior Publication Data

US 2021/0063066 A1 Mar. 4, 2021

(30) Foreign Application Priority Data

Jan. 5, 2018 (CN) ..... 201810010469.1

(51) Int. Cl.
*F25B 41/20* (2021.01)
*F25B 13/00* (2006.01)
(Continued)

(52) U.S. Cl.
CPC ..... *F25B 41/20* (2021.01); *F25B 13/00* (2013.01); *F25B 43/003* (2013.01); *F25B 47/02* (2013.01)

(58) Field of Classification Search
CPC ..... F25B 13/00; F25B 41/20; F25B 43/003; F25B 47/02; F25B 31/004; F25B 43/006;
(Continued)

(56) References Cited

U.S. PATENT DOCUMENTS 5,651,263 A 7/1997 Nonaka et al.
2007/0163296 A1 7/2007 Suzuki et al.

FOREIGN PATENT DOCUMENTS

CN 101000178 A 7/2007
CN 201983527 U 9/2011
(Continued)

OTHER PUBLICATIONS

Nokia Networks, "DCI design for NB-IoT", 3GPP TSG-RAN WG1 NB-IoT Adhoc, Budapest, Hungary, Jan. 18-20, 2016, total 3 pages, R1-160017.

*Primary Examiner* — Kun Kai Ma
(74) *Attorney, Agent, or Firm* — Kilpatrick Townsend & Stockton, LLP

(57) ABSTRACT

A circulation system of an air conditioner, an air conditioner, and an air conditioner control method. The circulation system of the air conditioner includes a compressor, a first heat exchanger, a second heat exchanger, and a gas-liquid separation assembly. The gas-liquid separation assembly, together with the compressor, the first heat exchanger, and the second heat exchanger, forms a loop; the gas-liquid separation assembly includes two or more gas-liquid separators which are connected in series; the gas-liquid separation assembly is configured to perform gas-liquid separation for refrigerant. Further, two or more-staged gas-liquid separation can be performed for the refrigerant flowing back to the compressor, so that a problem that return oil containing liquid in the compressor can be effectively solved.

17 Claims, 4 Drawing Sheets

(51) Int. Cl.
*F25B 43/00* (2006.01)
*F25B 47/02* (2006.01)

(58) Field of Classification Search
CPC ..... F25B 2313/0272; F25B 2400/053; F25B 2400/054
See application file for complete search history.

(56) References Cited

FOREIGN PATENT DOCUMENTS

| | | | | | |
|---|---|---|---|---|---|
| CN | 202521961 | U | | 11/2012 | |
| CN | 102878650 | A | | 1/2013 | |
| CN | 104315742 | A | * | 1/2015 | |
| CN | 104848599 | A | * | 8/2015 | |
| CN | 105352232 | A | | 2/2016 | |
| CN | 105571183 | A | * | 5/2016 | |
| CN | 106766424 | A | * | 5/2017 | |
| CN | 107024031 | A | * | 8/2017 | ..... F25B 29/003 |
| CN | 108036554 | A | | 5/2018 | |
| CN | 201954682 | U | | 5/2018 | |
| CN | 207849836 | U | | 9/2018 | |
| CN | 108662816 | A | * | 10/2018 | ..... F25B 31/004 |
| EP | 1022524 | A1 | * | 7/2000 | ..... F25B 45/00 |
| EP | 2667120 | B1 | * | 8/2016 | ..... F25B 43/003 |
| EP | 3059521 | A1 | | 8/2016 | |
| GB | 2435088 | A | | 8/2007 | |
| JP | 2009270745 | A | | 11/2009 | |
| JP | 5195364 | B2 | | 5/2013 | |

* cited by examiner

CIRCULATION SYSTEM OF AIR CONDITIONER, AIR CONDITIONER, AND AIR CONDITIONER CONTROL METHOD

CROSS-REFERENCE TO RELATED APPLICATION

This application is a U.S. National Stage of International Application No. PCT/CN2018/121183, filed on Dec. 14, 2018, which claims priority to the Chinese patent application No. 201810010469.1, filed on Jan. 5, 2018, the contents of which are herein incorporated by reference in their entireties.

FIELD

The present disclosure relates to the field of air conditioning, in particular to a circulation system of an air conditioner, an air conditioner and an air conditioner control method.

BACKGROUND

A related air conditioning system includes an indoor heat exchanger, an outdoor heat exchanger and a compressor, and refrigerant circulates in a loop formed by the above components. As for the indoor heat exchanger and the outdoor heat exchanger, one serves as an evaporator, and the other serves as a condenser. The high-temperature and high-pressure refrigerant from the compressor enters the condenser to condense into a liquid, then flows into the evaporator to evaporate into a low-temperature and low-pressure gas, and finally returns to the compressor.

Inventors recognize that when the compressor is switched to a defrosting mode, due to a switching of a four-way valve, liquid hammering easily occurs in the compressor at an instant of switching, which may damage the compressor.

SUMMARY

Disclosed embodiments provide a circulation system of an air conditioner, an air conditioner and an air conditioner control method to improve a problem of return oil containing liquid in a compressor.

The present disclosure provides a circulation system of an air conditioner, including:

a compressor;

a first heat exchanger;

a second heat exchanger; and a gas-liquid separation assembly; the gas-liquid separation assembly, together with the compressor, the first heat exchanger, and the second heat exchanger, forms a loop; the gas-liquid separation assembly includes two or more gas-liquid separators, the gas-liquid separators each are connected in series, and the gas-liquid separation assembly is configured to perform gas-liquid separation for refrigerant.

In some embodiments, the gas-liquid separation assembly includes a first gas-liquid separator;

the first gas-liquid separator includes a heat exchange branch and a gas-liquid separation branch; a refrigerant inlet of the heat exchange branch is selectively in communication with a first opening of the first heat exchanger or a second opening of the second heat exchanger; a refrigerant outlet of the heat exchange branch is selectively in communication with the second opening of the second heat exchanger or the first opening of the first heat exchanger; a refrigerant inlet of the gas-liquid separation branch is selectively in communication with a first opening of the second heat exchanger or a second opening of the first heat exchanger; and a refrigerant outlet of the gas-liquid separation branch is in communication with a refrigerant inlet of the compressor.

In some embodiments, the gas-liquid separation assembly further includes a second gas-liquid separator;

the refrigerant outlet of the gas-liquid separation branch is in communication with a refrigerant inlet of the second gas-liquid separator, and a refrigerant outlet of the second gas-liquid separator is in communication with the refrigerant inlet of the compressor.

In some embodiments, the circulation system of the air conditioner further includes an oil return branch;

an oil return branch inlet of the oil return branch is in communication with an oil return hole of the first heat exchanger; the oil return hole is located at a height corresponding to oil in the first heat exchanger; and an oil return branch outlet of the oil return branch is in communication with the refrigerant inlet of the second gas-liquid separator and/or the refrigerant outlet of the gas-liquid separation branch.

In some embodiments, the return oil branch is provided with a control valve configured to control the return oil branch to be turned on or off.

In some embodiments, a refrigerant outlet of the compressor is in communication with the second opening of the first heat exchanger. The first opening of the first heat exchanger is in communication with the refrigerant inlet of the heat exchange branch. The refrigerant outlet of the heat exchange branch is in communication with the second opening of the second heat exchanger. The first opening of the second heat exchanger is in communication with the refrigerant inlet of the gas-liquid separation branch. The refrigerant outlet of the gas-liquid separation branch is in communication with the refrigerant inlet of the compressor.

In some embodiments, a refrigerant outlet of the compressor is in communication with the first opening of the second heat exchanger. The second opening of the second heat exchanger is in communication with the refrigerant inlet of the heat exchange branch. The refrigerant outlet of the heat exchange branch is in communication with the first opening of the first heat exchanger. The second opening of the first heat exchanger is in communication with the refrigerant inlet of the gas-liquid separation branch. The refrigerant outlet of the gas-liquid separation branch is in communication with the refrigerant inlet of the compressor.

In some embodiments, the circulation system of the air conditioner further includes a four-way valve; a first opening of the four-way valve is in communication with the refrigerant outlet of the compressor; a second opening of the four-way valve is in communication with the second opening of the first heat exchanger; a third opening of the four-way valve is in communication with the refrigerant inlet of the gas-liquid separation branch; and a fourth opening of the four-way valve is in communication with the first opening of the second heat exchanger.

In which, the first opening of the four-way valve is in communication with the second opening of the four-way valve, and the third opening of the four-way valve is in communication with the fourth opening of the four-way valve; or the first opening of the four-way valve is in communication with the fourth opening of the four-way valve, and the second opening of the four-way valve is in communication with the third opening of the four-way valve.

In some embodiments, the first heat exchanger includes a shell and tube heat exchanger, and/or the second heat exchanger includes a finned heat exchanger.

In some embodiments, a first filter and a first one-way valve are provided between the refrigerant outlet of the heat exchange branch and the first opening of the first heat exchanger.

In some embodiments, a second filter and a second one-way valve are provided between the second opening of the second heat exchanger and the refrigerant inlet of the heat exchange branch.

In some embodiments, a third filter is provided between the first one-way valve and the first opening of the first heat exchanger.

In some embodiments, a fourth filter is provided between the second opening of the first heat exchanger and the refrigerant inlet of the gas-liquid separation branch, and the fourth filter is also disposed between the second opening of the first heat exchanger and a refrigerant outlet of the compressor.

In some embodiments, the first filter and a fourth one-way valve are provided between the refrigerant outlet of the heat exchange branch and the second opening of the second heat exchanger.

In some embodiments, an electronic expansion valve is further provided between the first filter and the fourth one-way valve, and the electronic expansion valve is also disposed between the first filter and the first one-way valve.

In some embodiments, the third filter and a third one-way valve are provided between the first opening of the first heat exchanger and the refrigerant inlet of the heat exchange branch.

In some embodiments, the circulation system of the air conditioner includes a first operating mode and/or a second operating mode.

In some embodiments, the first operating mode includes a heating mode.

In some embodiments, the second operating mode includes a refrigerating mode and a defrosting mode.

In some embodiments, the circulation system of the air conditioner further includes an oil return branch;

an oil return branch inlet of the oil return branch is in communication with an oil return hole of the first heat exchanger; an oil return branch outlet of the oil return branch is connected to a preset position; the preset position is located in a flow path between a refrigerant outlet of one gas-liquid separator, which is in the gas-liquid separation assembly and located upstream of a flow direction of the refrigerant, and a refrigerant inlet of another gas-liquid separator, which is in the gas-liquid separation assembly and located downstream of a flow direction of the refrigerant.

Another embodiment of the present disclosure provides an air conditioner including the circulation system of the air conditioner provided by any embodiment of the present disclosure.

Yet another embodiment of the present disclosure provides an air conditioner control method. The method includes a step of controlling refrigerant to flow according to a path that the refrigerant from a compressor flows to a first heat exchanger, a heat exchange branch of a first gas-liquid separator, a second heat exchanger, a gas-liquid separation branch of the first gas-liquid separator, and a second gas-liquid separator, and then flows back to the compressor.

Yet another embodiment of the present disclosure provides an air conditioner control method. The method includes a step of controlling refrigerant to flow according to a path that the refrigerant from a compressor flows to a second heat exchanger, a heat exchange branch of a first gas-liquid separator, a first heat exchanger, a gas-liquid separation branch of the first gas-liquid separator, and a second gas-liquid separator, and then flows back to the compressor.

In the circulation systems of the air conditioner provided by the embodiments of the present disclosure, the gas-liquid separation assembly thereof includes two or more gas-liquid separators connected in series. Each of the gas-liquid separators performs gas-liquid separation for the refrigerant, thereby reducing the problem of return oil containing liquid in the compressor. Even when the circulation system of the air conditioner is switched to the defrosting mode, the problem of the return oil containing liquid in a compressor is effectively reduced or even avoided.

DETAILED DESCRIPTION OF EMBODIMENTS

The embodiments of the present disclosure will be described in more detail below with reference to FIGS. 1 to 4.

Figure 1:
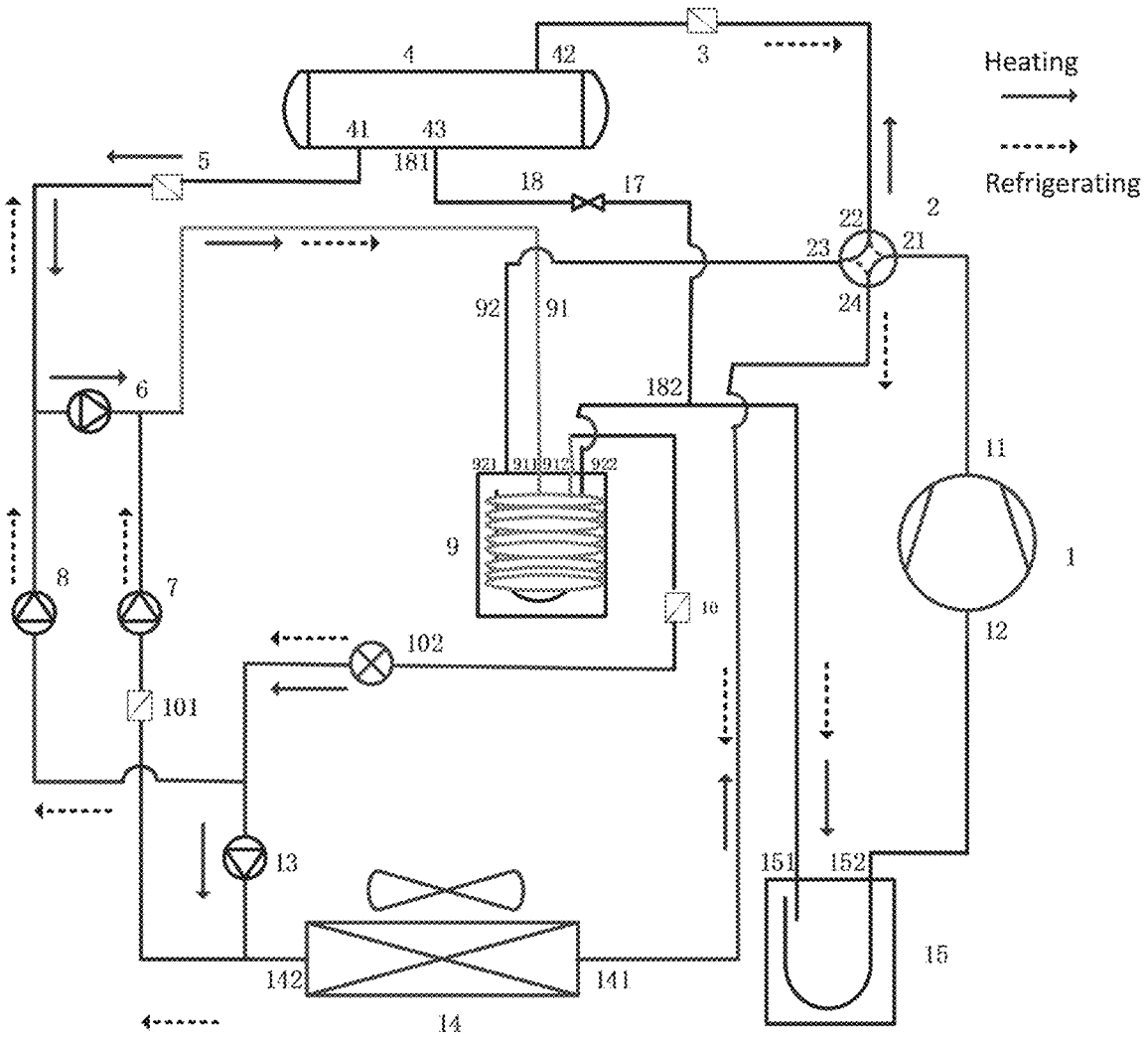
FIG. 1 is a schematic diagram illustrating a principle of a circulation system an air conditioner provided by some embodiments of the present disclosure.
Figure 2:
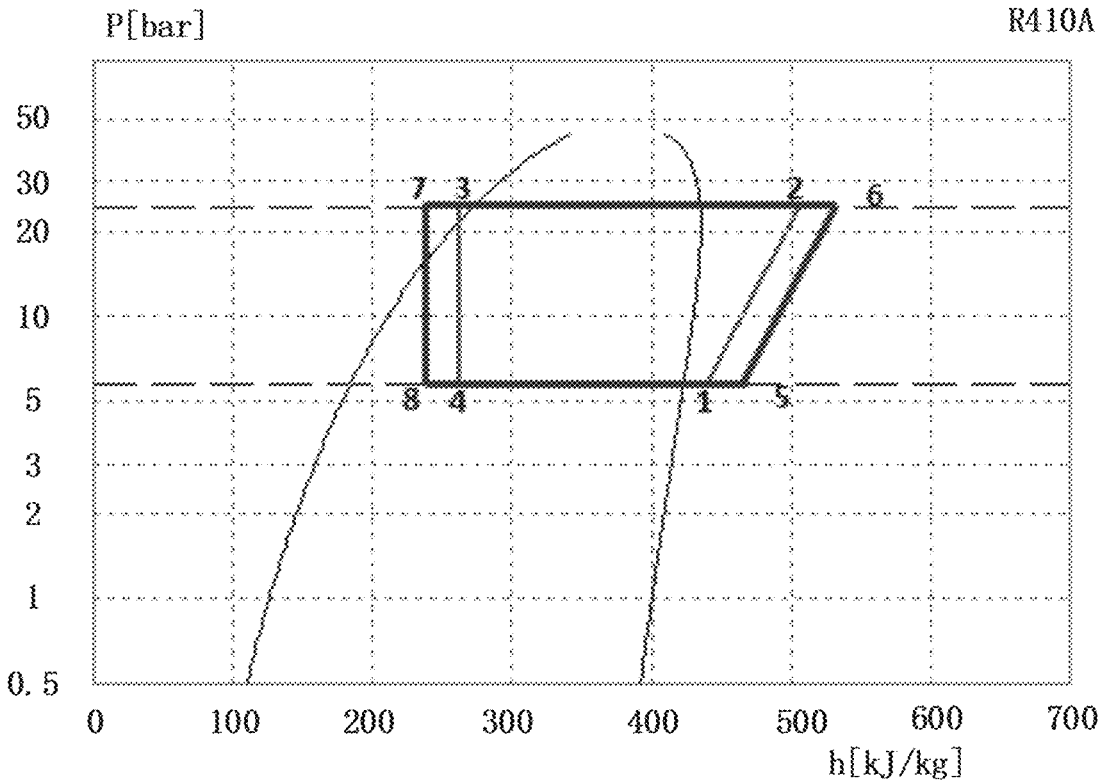
FIG. 2 is an enthalpy diagram of the circulation system of the air conditioner provided by some embodiments of the present disclosure.

Referring to FIG. 1, this embodiment provides a circulation system of an air conditioner, including a compressor 1, a first heat exchanger 4, a second heat exchanger 14, and a gas-liquid separation assembly. The gas-liquid separation assembly, together with the compressor 1, the first heat exchanger 4, and the second heat exchanger 14, forms a loop. The gas-liquid separation assembly includes two or more gas-liquid separators; the gas-liquid separators each are connected in series; and the gas-liquid separation assembly is configured to perform gas-liquid separation for refrigerant.

Each of the heat exchangers is, such as a finned heat exchanger, or a flooded shell and tube heat exchanger, etc. Structures of a plurality of the gas-liquid separators included in the gas-liquid separation assembly are identical or different.

The gas-liquid separators being connected in series means that the refrigerant flows through each of the gas-liquid separators, so that the refrigerant undergoes multiple-staged gas-liquid separation. For example, other components are provided between the gas-liquid separators connected in series. In one embodiment, if the gas-liquid separation assembly includes two gas-liquid separators, another component is provided between the two gas-liquid separators, so that the refrigerant flows through one of the gas-liquid separators, the other component, and then to another gas-liquid separator. If the gas-liquid separation assembly includes three or more gas-liquid separators, another component is provided between two of the gas-liquid separators, so that the refrigerant flows through one of the gas-liquid separators, the other component, and then to another gas-liquid separator. The remaining gas-liquid separators are, for example, adjacent to or separated from either of the gas-liquid separators.

In some embodiments, referring to FIG. 1, the gas-liquid separation assembly includes a first gas-liquid separator 9 having the following structure. The first gas-liquid separator 9 includes a heat exchange branch 91 and a gas-liquid separation branch 92. A refrigerant inlet 911 of the heat exchange branch 91 can be selectively in communication with a first opening 41 of the first heat exchanger 4 or a second opening 142 of the second heat exchanger 14. A refrigerant outlet 912 of the heat exchange branch 91 is selectively in communication with the second opening 142 of the second heat exchanger 14 or the first opening 41 of the first heat exchanger 4. A refrigerant inlet 921 of the gas-liquid separation branch 92 can be selectively in communication with a first opening 141 of the second heat exchanger 14 or a second opening 42 of the first heat exchanger 4. A refrigerant outlet 922 of the gas-liquid separation branch 92 is in communication with a refrigerant inlet 12 of the compressor 1.

In the embodiments of the present disclosure, the first gas-liquid separator 9 with a heat exchange function is provided, and high-temperature liquid refrigerant from a condenser exchanges heat with low-temperature gaseous refrigerant from an evaporator in the first gas-liquid separator 9, so that temperature of the high-temperature liquid refrigerant is decreased to increase a supercooling degree, and that at the same time, temperature of the low-temperature gaseous refrigerant is increased to increase a superheat degree, thereby improving the capacity of the air conditioner. This exchange improves a heat exchange capacity of the circulation system of the air conditioner.

Figure 3:
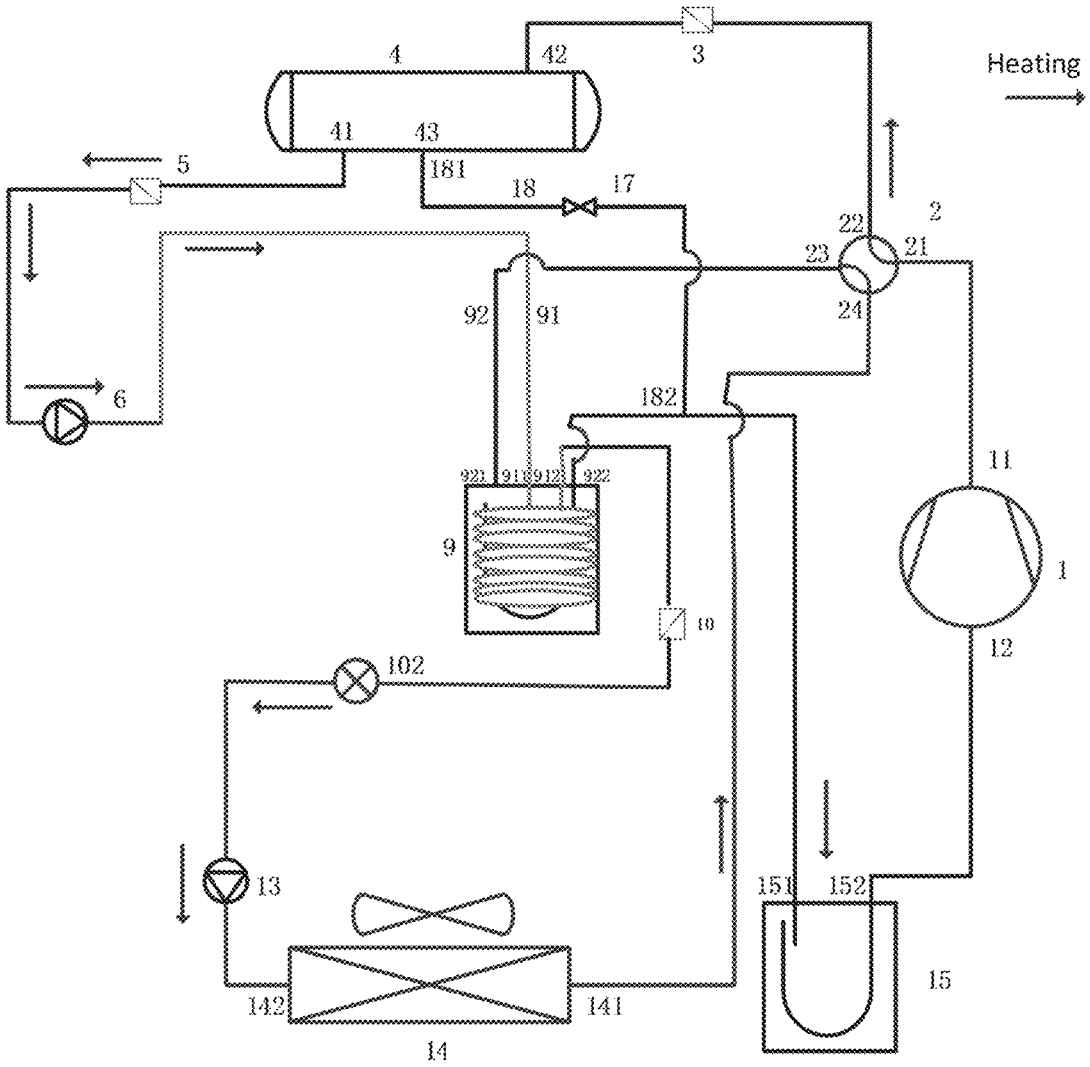
FIG. 3 is a schematic diagram illustrating a principle of a first operating mode of the circulation system of the air conditioner provided by some embodiments of the present disclosure.

The above-mentioned circulation system of the air conditioner can operate in a first operating mode and a second operating mode. The first operating mode includes a heating mode. When the circulation system of the air conditioner is in the heating mode, a schematic diagram of a refrigerant circulation thereof is shown in FIG. 3.

Figure 4:
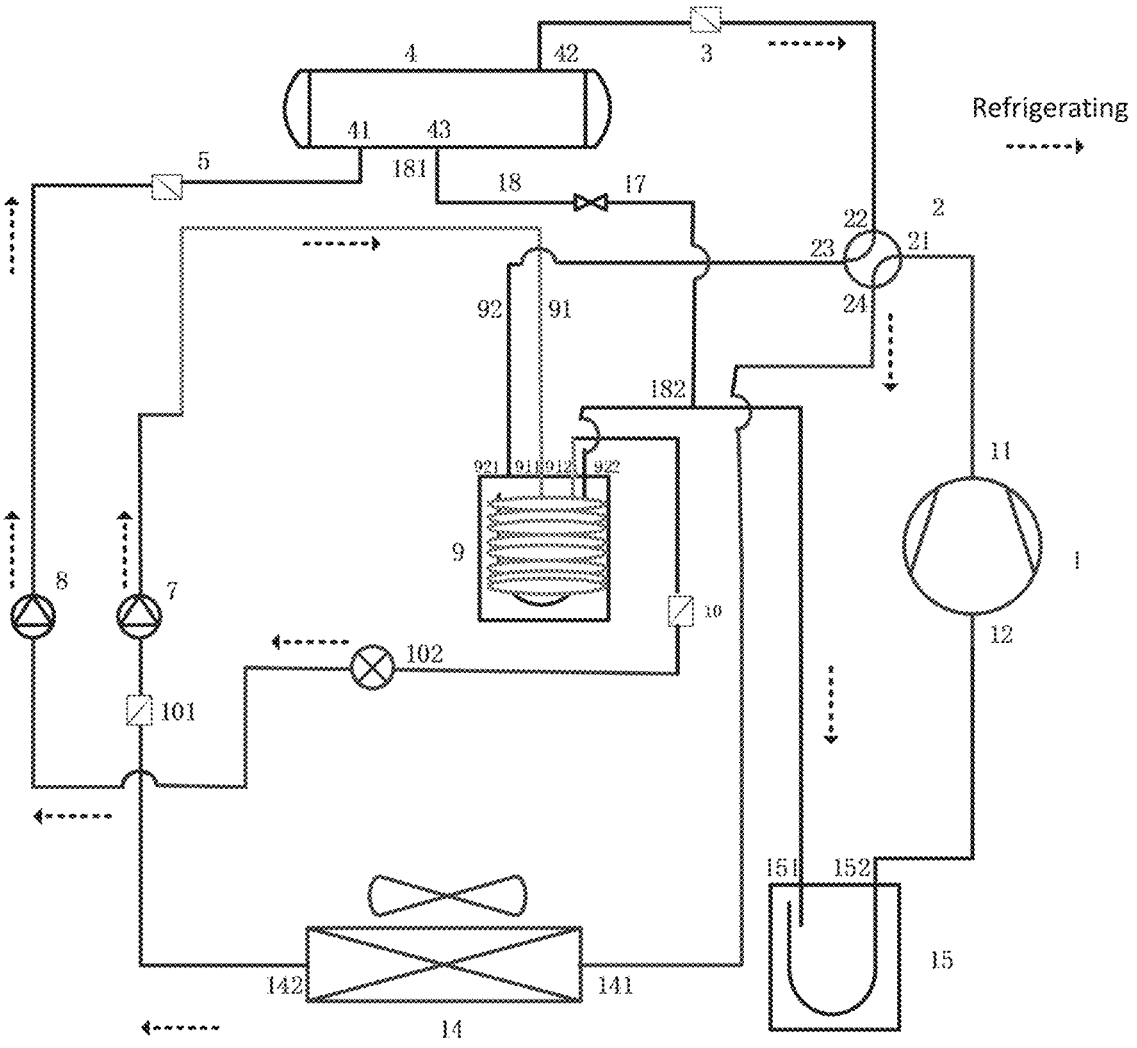
FIG. 4 is a schematic diagram illustrating a principle of a second operating mode of the circulation system of the air conditioner provided by some embodiments of the present disclosure.

In some embodiments, the second operating mode includes a refrigerating mode and a defrosting mode. When the circulation system of the air conditioner is in the refrigerating mode, a schematic diagram of the refrigerant circulation is shown in FIG. 4. In the defrosting mode, a schematic diagram of the refrigerant circulation is basically the same as that in the refrigerating mode.

The above-mentioned circulation system of the air conditioner can be in a following communication state: a refrigerant outlet 11 of the compressor 1 is in communication with the second opening 42 of the first heat exchanger 4; the first opening 41 of the first heat exchanger 4 is in communication with the refrigerant inlet 911 of the heat exchange branch 91; the refrigerant outlet 912 of the heat exchange branch 91 is in communication with the second opening 142 of the second heat exchanger 14; the first opening 141 of the second heat exchanger 14 is in communication with the refrigerant inlet 921 of the gas-liquid separation branch 92; and the refrigerant outlet 922 of the gas-liquid separation branch 92 is in communication with the refrigerant inlet 12 of the compressor 1.

In a case that the above-mentioned communication state is arranged for the first operating mode of the circulation system of the air conditioner, the refrigerant flows according to a following path: the refrigerant from the compressor 1 flows through the first heat exchanger 4, the heat exchange branch 91 of the first gas-liquid separator 9, the second heat exchanger 14, and the gas-liquid separation branch 92 of the first gas-liquid separator 9, and then flows back to the compressor 1.

The above-mentioned circulation system of the air conditioner can also be in a following communication state: the refrigerant outlet 11 of the compressor 1 is in communication with the first opening 141 of the second heat exchanger 14; the second opening 142 of the second heat exchanger 14 is in communication with the refrigerant inlet 911 of the heat exchange branch 91; the refrigerant outlet 912 of the heat exchange branch 91 is in communication with the first opening 41 of the first heat exchanger 4; the second opening 42 of the first heat exchanger 4 is in communication with the refrigerant inlet 921 of the gas-liquid separation branch 92; and the refrigerant outlet 922 of the gas-liquid separation branch 92 is in communication with the refrigerant inlet 12 of the compressor 1.

In a case that the above-mentioned communication state is arranged for the second operating mode of the circulation system of the air conditioner, the refrigerant flows according to a following path: the refrigerant from the compressor 1 flows through the second heat exchanger 14, the heat exchanger branch 91 of the first gas-liquid separator 9, the first heat exchanger 4, and the gas-liquid separation branch 92 of the first gas-liquid separator 9, and then flows back to the compressor 1.

Referring to FIG. 1, FIG. 3 or FIG. 4, the circulation system of the air conditioner further includes a second gas-liquid separator 15; the refrigerant outlet 922 of the gas-liquid separation branch 92 is in communication with a refrigerant inlet 151 of the second gas-liquid separator 15; and a refrigerant outlet 152 of the second gas-liquid separator 15 is in communication with the refrigerant inlet 12 of the compressor 1.

When the circulation system of the air conditioner is in the first operating mode, the refrigerant flows according to a following path: the refrigerant from the compressor 1 flows through the first heat exchanger 4, the heat exchange branch 91 of the first gas-liquid separator 9, the second heat exchanger 14, the gas-liquid separation branch 92 of the first gas-liquid separator 9, and the second gas-liquid separator 15, and then flows back to the compressor 1.

When the circulation system of the air conditioner is in the second operating mode, the refrigerant flows according to a following path: the refrigerant from the compressor 1 flows through the second heat exchanger 14, the heat exchange branch 91 of the first gas-liquid separator 9, the first heat exchanger 4, the gas-liquid separation branch 92 of the first gas-liquid separator 9, and the second gas-liquid separator 15, and then flows back to the compressor 1.

In the embodiments of the present disclosure, the second gas-liquid separator 15 is provided. When the circulation system of the air conditioner is in the first and second operating modes, the liquid refrigerant from the first heat exchanger 4 continuously flows through the gas-liquid separation branch 92 of the first gas-liquid separator 9 and the second gas-liquid separator 15. After two-staged gas-liquid separation, the separation effect is improved, and the amount of liquid returned with the refrigerant is greatly reduced, thereby effectively improving the problem of return refrigerant containing liquid in the compressor 1.

The high-temperature refrigerant in the heat exchange branch 91 can exchange heat with the low-temperature refrigerant in the gas-liquid separation branch 92. In one embodiment, the high-temperature liquid refrigerant from the condenser exchanges heat with the low-temperature gaseous refrigerant from the evaporator in the gas-liquid separator. Accordingly, a temperature of the high-temperature liquid refrigerant decreases, and the supercooling degree is increased (from point 7 to point 3 in FIG. 2), a temperature of the low-temperature gaseous refrigerant increases, and the superheat degree is increased (from point 1 to point 5 in FIG. 2);a refrigerating capacity is increased from a segment of point 4 to point 1 to a segment of point 8 to point 5 in FIG. 2, and two segments of point 8 to point 4 and point 1 to point 5 are added.

In one or more embodiments, the circulation system of the air conditioner further includes an oil return branch 18. An oil return branch inlet 181 of the oil return branch is in communication with an oil return hole 43 of the first heat exchanger 4, and an oil return branch outlet 182 of the oil return branch 18 is connected to a preset position. The preset position is located in a flow path between the refrigerant outlet of one gas-liquid separator, which is in the gas-liquid separation assembly and located upstream of a flow direction of the refrigerant, and the refrigerant inlet of another gas-liquid separator, which is in the gas-liquid separation assembly and located downstream of the flow direction of the refrigerant.

The oil return branch 18 make use of a pressure loss formed by each of the gas-liquid separators located upstream of a connection position of the oil return branch outlet 182 thereof to suck oil from the first heat exchanger 4. In this embodiment, the oil return branch 18 makes use of a pressure loss formed by the gas-liquid separation branch 92 to suck the oil into the second gas-liquid separator 15.

In order to improve the lubrication of the compressor 1, the oil return branch 18 is further provided. The oil return branch inlet 181 of the oil return branch 18 is in communication with the oil return hole 43 of the first heat exchanger 4. The oil return hole 43 is located at a height corresponding to the oil in the first heat exchanger 4. The oil return branch outlet 182 of the oil return branch 18 is in communication with the refrigerant inlet 151 of the second gas-liquid separator 15; alternatively, the oil return branch outlet 182 of the oil return branch 18 is in communication with the refrigerant outlet 922 of the gas-liquid separation branch 92.

When oil return is required in the circulation system of the air conditioner, the oil return branch 18 is turned on, that is, the oil accumulated in the first heat exchanger 4 is sucked into the second gas-liquid separator 15 through the oil return branch 18.

In the embodiment, the return oil branch 18 is provided with a control valve 17 configured to control the return oil branch 18 to be turned on or off. The control valve 17 is provided, thereby conveniently controlling the oil return branch 18 to be turned on when required.

Referring to FIG. 1, the circulation system of the air conditioner further includes a four-way valve 2. A first opening 21 of the four-way valve 2 is in communication with the refrigerant outlet 11 of the compressor 1. A second opening 22 of the four-way valve 2 is in communication with the second opening 42 of the first heat exchanger 4. A third opening 23 of the four-way valve 2 is in communication with the refrigerant inlet 921 of the gas-liquid separation branch 92. A fourth opening 24 of the four-way valve 2 is in communication with the first opening 141 of the second heat exchanger 14.

The four-way valve 2 serves as a switching valve, and four openings thereof have two following selectable communication states.

A first communication state: the first opening 21 of the four-way valve 2 is in communication with the second opening 22 of the four-way valve 2, and the third opening 23 of the four-way valve 2 is in communication with the fourth opening 24 of the four-way valve 2. This case is applicable when the circulation system of the air conditioner is in the first operating mode.

A second communication state: the first opening 21 of the four-way valve 2 is in communication with the fourth opening 24 of the four-way valve 2, and the second opening 22 of the four-way valve 2 is in communication with the third opening 23 of the four-way valve 2. This case is applicable when the circulation system of the air conditioner is in the second operating mode.

After the four-way valve 2 is provided, and when the circulation system of the air conditioner is in the first operating mode, the refrigerant flows according to a following path: the refrigerant from the compressor 1 flows through the four-way valve 2, the first heat exchanger 4, the heat exchange branch 91 of the first gas-liquid separator 9, the second heat exchanger 14, the four-way valve 2, and the gas-liquid separation branch 92 of the first gas-liquid separator 9, and then flows back to the compressor 1.

After the four-way valve 2 is provided, and when the circulation system of the air conditioner is in the second operating mode, the refrigerant flows according to a following path: the refrigerant from the compressor 1 flows through the four-way valve 2, the second heat exchanger 14, the heat exchange branch 91 of the first gas-liquid separator 9, the first heat exchanger 4, the four-way valve 2, and the gas-liquid separation branch 92 of the first gas-liquid separator 9, and then flows back to the compressor 1.

In one or more embodiments, the first heat exchanger 4 includes a shell and tube heat exchanger, and/or, the second heat exchanger 14 includes a finned heat exchanger.

The flooded shell and tube heat exchanger has the characteristics of a large refrigerating capacity and a high energy efficiency ratio, therefore when serving as an indoor heat exchanger, the first heat exchanger 4 may be the shell-and-tube heat exchanger. The embodiments of the present disclosure takes advantages of the large refrigerating capacity and the high energy efficiency ratio of the first heat exchanger 4, and under a pressure difference formed by the pressure loss of the first gas-liquid separator 9, the separately provided oil return branch 18 sucks out lubricating oil inside the first heat exchanger 4 and transports the lubricating oil to the second gas-liquid separator 15, thus solving the problem of a large amount of oil accumulated in the shell tube, and improving the heat exchange effect in the shell tube, and ensuring that the compressor 1 has sufficient lubricating oil.

Referring to FIG. 1, a first filter 10 and a first one-way valve 8 are provided between the refrigerant outlet 912 of the heat exchange branch 91 of the first gas-liquid separator 9 and the first opening 41 of the first heat exchanger 4.

When the circulation system of the air conditioner is in the second operating mode, the first one-way valve 8 is turned on. The first one-way valve 8 is provided, thereby rapidly controlling whether the branch where the first one-way valve 8 is disposed is turned on in each operating mode.

Referring to FIG. 1, a second filter 101 and a second one-way valve 7 are provided between the second opening 142 of the second heat exchanger 14 and the refrigerant inlet 911 of the heat exchange branch 91 of the first gas-liquid separator 9.

When the circulation system of the air conditioner is in the second operating mode, the second one-way valve 7 is turned on. The second one-way valve 7 is provided, thereby rapidly controlling whether the branch where the second one-way valve 7 is disposed is turned on in each operating mode.

Referring to FIG. 1, a third filter 5 is provided between the first one-way valve 8 and the first opening 41 of the first heat exchanger 4. Referring to FIG. 3, in the first operating mode, the third filter 5 is configured to filter impurities in the refrigerant flowing from the first heat exchanger 4. Referring to FIG. 4, in the second operating mode, the third filter 5 is configured to filter impurities in the refrigerant flowing from the gas-liquid separation branch 92 of the first gas-liquid separator 9 to keep the impurities from flowing into the first heat exchanger 4.

Referring to FIG. 1, a fourth filter 3 is provided between the second opening 42 of the first heat exchanger 4 and the refrigerant inlet 921 of the gas-liquid separation branch 92. The fourth filter 3 is also disposed between the second opening 42 of the first heat exchanger 4 and the refrigerant outlet 11 of the compressor 1. Referring to FIG. 3, in the first operating mode, the fourth filter 3 filters impurities in the refrigerant flowing from the compressor 1 before the refrigerant flows into the first heat exchanger 4, to keep the impurities from flowing into the first heat exchanger 4. Referring to FIG. 4, in the second operating mode, the fourth filter 3 filters impurities in the refrigerant flowing from the first heat exchanger 4 before the refrigerant flows into the refrigerant inlet 921 of the gas-liquid separation branch 92 of the first gas-liquid separator 9, to keep the impurities from flowing into the four-way valve 2.

Referring to FIGS. 1 and 3, the first filter 10 and a fourth one-way valve 13 are provided between the refrigerant outlet 912 of the heat exchange branch 91 and the second opening 142 of the second heat exchanger 14. When the circulation system of the air conditioner is in the first operating mode, the fourth one-way valve 13 is turned on.

Referring to FIG. 3 or FIG. 4, an electronic expansion valve 102 is further provided between the first filter 10 and the fourth one-way valve 13, and the electronic expansion valve 102 is also disposed between the first filter 10 and the first one-way valve 8. The electronic expansion valve 102 is provided to achieve throttling.

Referring to FIG. 3 or FIG. 4, the third filter 5 and a third one-way valve 6 are provided between the first opening 41 of the first heat exchanger 4 and the refrigerant inlet 911 of the heat exchange branch 91. When the circulation system of the air conditioner is in the first operating mode, the third one-way valve 6 is turned on. When the circulation system of the air conditioner is in the second operating mode, the third one-way valve 6 is turned off.

Some specific embodiments are described below with reference to FIGS. 1 to 4.

Take the circulation system of the air conditioner shown in FIG. 1 as an example.

During a refrigerating circulation: the refrigerant flows in a shell side of the first heat exchanger 4, absorbs heat of the refrigerating medium in a tube side, and continuously evaporates; gaseous refrigerant reaching the first opening 41 of the first heat exchanger 4 flows through the first gas-liquid separator 9 and the second gas-liquid separator 15 sequentially; and after a gas-liquid separation, the gaseous refrigerant enters the inlet of the compressor 1, thereby completing the gas-liquid separation. The oil return hole 43 is disposed adjacent to the liquid level of the oil in the first heat exchanger 4, and under a pressure difference, the lubricating oil with liquid refrigerant is introduced into the refrigerant inlet 151 of the second gas-liquid separator 15 through the tube 18. After the gas-liquid separation, the lubricating oil is sucked into the refrigerant inlet 12 of the compressor 1, and the oil return in the compressor 1 is completed.

The high-pressure gas compressed by the compressor 1 enters the second heat exchanger 14 serving as a condenser through the refrigerant outlet 11 of the compressor 1 and condenses into high-temperature liquid refrigerant, and the released heat is taken away. After the condensed liquid passes through the second filter 101, which removes impurities, the condensed liquid enters the first gas-liquid separator 9 through the second one-way valve 7 and exchanges heat, in the first gas-liquid separator 9, with the low-temperature gaseous refrigerant from the first heat exchanger 4, thus reducing temperature of the high-temperature liquid refrigerant to increase the supercooling degree, while increasing temperature of the low-temperature gaseous refrigerant to increase the superheat degree. After exchanging heat, the high-temperature liquid refrigerant flows out of the first gas-liquid separator 9 and flows through the first filter 10, and then is throttled by the electronic expansion valve 102 to be low-pressure liquid refrigerant. Then the low-pressure liquid refrigerant flows through the first one-way valve 8 and the third filter 5 and enters the first heat exchanger 4. The circulation of the refrigerant is completed.

Referring to FIGS. 1 and 4, during the refrigerating circulation, the pressure difference formed by the pressure loss of the first gas-liquid separator 9 makes the oil in the evaporator return to the inlet of the second gas-liquid separator 15, and the oil and the refrigerant flow through the second gas-liquid separator 15, and gas and liquid are separated, thus not only introducing the oil in the evaporator back to the compressor 1, but also avoiding the liquid hammering generated during the oil return process, while avoiding providing an oil separator in a flooded shell and tube system.

During refrigerating, the first heat exchanger 4 serves as an evaporator, temperature of the refrigerant in the evaporator is very low, therefore the viscosity of the lubricating oil that enters the evaporator is large, and it is not easy for the refrigerant to bring the lubricating oil back to the compressor 1. On one aspect, the lubricating oil accumulated in the evaporator will affect the heat exchange efficiency; and on the other aspect, the compressor 1 will be damaged because of a lack of oil caused by failure to return oil. In the above embodiments, two gas-liquid separators are provided, and each of the gas-liquid separators has a pressure loss. The oil return hole 43 is disposed adjacent to the oil level of the evaporator. Under the pressure difference formed by the pressure loss of the first gas-liquid separator 9, the oil and the liquid refrigerant flow through the tube 18 and the outlet of the oil return branch 182 and enter the second gas-liquid separator 15 to be separated, and the oil is introduced into a gas admission port of the compressor 1, thus not only solving the problem of the return oil in the compressor 1, but also solving the problem of return oil containing liquid. Moreover, controlled by a solenoid valve serving as the control valve 17, selectively, the tube 18 is provided for return oil only during refrigerating; and the control valve 17 is turned off during heating, and the branch is blocked. In some embodiments, in the heating mode, the control valve 17 is also turned on, and the branch operates at this time. This solution solves the problem of the oil return in the compressor 1 in the heating mode.

The principles of a defrosting circulation and the refrigerating circulation are basically identical. When a unit defrosts, in the embodiments of the present disclosure, two gas-liquid separators are provided. The gaseous refrigerant containing liquid from the evaporator enters from the upper part. Depending on the reduction of a speed of a gas flow and a change of a direction of the gas flow, the liquid or oil drops carried by the low-pressure gaseous refrigerant is separated, and the gaseous refrigerant and the carried lubricating oil are sucked into the compressor 1 through the oil return hole 43. Two-staged gas-liquid separation is carried out by two gas-liquid separators, which greatly reduces the possibility of the liquid hammering, thereby extending the service life of the compressor 1 and improving the reliability of the unit.

Referring to FIGS. 1 and 3, during the heating circulation, the refrigerant flows in the second heat exchanger 14 serving as an evaporator, absorbs heat from outside, and continuously evaporates. When the refrigerant reaches the first opening 141 of the second heat exchanger 14, the refrigerant turns into gas. The first gas-liquid separator 9 and the second gas-liquid separator 15 are connected in series. The refrigerant flows through the first gas-liquid separator 9 and the second gas-liquid separator 15. After the gas-liquid separation, the refrigerant enters the refrigerant inlet 12 of the compressor 1, and the gas-liquid separation is completed.

The high-pressure gas compressed by the compressor 1 enters the first heat exchanger 4 serving as a condenser through a high-pressure exhaust pipe and condenses into high-temperature liquid refrigerant. Released heat is taken away by a secondary refrigerant. After the condensed liquid flows through the third filter 5, which removes impurities, the condensed liquid enters the first gas-liquid separator 9 through the third one-way valve 6 and exchanges heat, in the first gas-liquid separator 9, with the low-temperature liquid refrigerant from the second opening of the second heat exchanger 14 serving as the evaporator, thereby decreasing the temperature of the high-temperature liquid refrigerant (increasing the supercooling degree), while increasing the temperature of the low-temperature gaseous refrigerant (increasing the superheat degree). After exchanging heat, the high-temperature liquid refrigerant flows out of the gas-liquid separator and flows through the first filter 10, and is throttled by the electronic expansion valve 102 to be a low-pressure liquid refrigerant. Then the low-pressure liquid refrigerant flows through the fourth one-way valve 13 and enters the second heat exchanger 14. The circulation of the refrigerant is completed.

In the embodiments of the present disclosure, the high-temperature liquid refrigerant flowing from the condenser first flows through the first gas-liquid separator 9 and exchanges heat, in the first gas-liquid separator 9, with the low-temperature gaseous refrigerant from the evaporator, thus decreasing the temperature of the liquid refrigerant as well as increasing supercooling degree, and increasing the temperature of the gaseous refrigerant as well as increasing the superheat degree, thereby improving the capacity. It can be seen that the arrangement of two gas-liquid separators solves four problems of oil return, gaseous refrigerant containing liquid, capacity and heat exchange efficiency of the unit.

Another embodiment of the present disclosure provides an air conditioner including the circulation system of the air conditioner provided by any embodiment of the present disclosure.

An embodiment of the present disclosure also provides an air conditioner control method. The method is performed by, for example, the air conditioner provided by any one of the above embodiments. This method corresponds to the first operating mode, and includes the following steps:

the refrigerant is controlled to flow according to a following path: the refrigerant from the compressor 1 flows into the first heat exchanger 4, the heat exchange branch 91 of the first gas-liquid separator 9, the second heat exchanger 14, the gas-liquid separation branch 92 of the first gas-liquid separator 9, and the second gas-liquid separator 15, and then flows back to the compressor 1.

An embodiment of the present disclosure also provides an air conditioner control method, which is performed by, for example, the air conditioner provided by any one of the above embodiments. This method corresponds to the second operating mode of the air conditioner, and includes the following steps:

the refrigerant is controlled to flow according to a following path: the refrigerant from the compressor 1 flows into the second heat exchanger 14, the heat exchange branch 91 of the first gas-liquid separator 9, the first heat exchanger 4, the gas-liquid separation branch 92 of the first gas-liquid separator 9, and the second gas-liquid separator 15, and then flows back to the compressor 1.

In the description of the present disclosure, it should be understood that the orientations or positional relationships indicated by the terms, such as "center", "longitudinal", "lateral", "front", "rear", "left", "right", "vertical", "horizontal", "top", "bottom", "inside", "outside", etc., are the orientations or positional relationships shown on the basis of the drawings, and are only intended to facilitate and simplify the description of the present disclosure, rather than intended to indicate or imply that the device or element involved may have the particular orientation or be constructed and operated in the particular orientation, thus, they cannot be understood as limitations on the protection scope of the present disclosure.

What is claimed is:

1. A circulation system of an air conditioner, comprising:

a compressor;

a first heat exchanger;

a second heat exchanger; and a gas-liquid separation assembly; wherein the gas-liquid separation assembly, together with the compressor, the first heat exchanger, and the second heat exchanger, forms a loop; the gas-liquid separation assembly comprises two or more gas-liquid separators; the two or more gas-liquid separators each are connected in series; and the gas-liquid separation assembly is configured to perform gas-liquid separation for refrigerant;

a first gas-liquid separator of the two or more gas-liquid separators comprises a heat exchange branch and a gas-liquid separation branch; a refrigerant inlet of the heat exchange branch is selectively in communication with a first opening of the first heat exchanger or a second opening of the second heat exchanger; a refrigerant outlet of the heat exchange branch is selectively in communication with the second opening of the second heat exchanger or the first opening of the first heat exchanger; a refrigerant inlet of the gas-liquid separation branch is selectively in communication with a first opening of the second heat exchanger or a second opening of the first heat exchanger; and a refrigerant outlet of the gas-liquid separation branch is in communication with a refrigerant inlet of the compressor.

2. The circulation system of the air conditioner according to claim 1, wherein the refrigerant outlet of the gas-liquid separation branch is in communication with a refrigerant inlet of a second gas-liquid separator of the two or more gas-liquid separators; and a refrigerant outlet of the second gas-liquid separator is in communication with the refrigerant inlet of the compressor.

3. The circulation system of the air conditioner according to claim 2, further comprising an oil return branch;

wherein an oil return branch inlet of the oil return branch is in communication with an oil return hole of the first heat exchanger; the oil return hole is located at a height corresponding to oil in the first heat exchanger; and an oil return branch outlet of the oil return branch is in communication with the refrigerant inlet of the second gas-liquid separator and/or the refrigerant outlet of the gas-liquid separation branch.

4. The circulation system of the air conditioner according to claim 3, wherein, the return oil branch is provided with a control valve configured to control the return oil branch to be turned on or off.

5. The circulation system of the air conditioner according to claim 1, wherein, a refrigerant outlet of the compressor is in communication with the second opening of the first heat exchanger; the first opening of the first heat exchanger is in communication with the refrigerant inlet of the heat exchange branch; the refrigerant outlet of the heat exchange branch is in communication with the second opening of the second heat exchanger; the first opening of the second heat exchanger is in communication with the refrigerant inlet of the gas-liquid separation branch; and the refrigerant outlet of the gas-liquid separation branch is in communication with the refrigerant inlet of the compressor.

6. The circulation system of the air conditioner according to claim 1, wherein, a refrigerant outlet of the compressor is in communication with the first opening of the second heat exchanger; the second opening of the second heat exchanger is in communication with the refrigerant inlet of the heat exchange branch; the refrigerant outlet of the heat exchange branch is in communication with the first opening of the first heat exchanger; the second opening of the first heat exchanger is in communication with the refrigerant inlet of the gas-liquid separation branch; and the refrigerant outlet of the gas-liquid separation branch is in communication with the refrigerant inlet of the compressor.

7. The circulation system of the air conditioner according to claim 1, further comprising a four-way valve;

wherein a first opening of the four-way valve is in communication with a refrigerant outlet of the compressor; a second opening of the four-way valve is in communication with the second opening of the first heat exchanger; a third opening of the four-way valve is in communication with the refrigerant inlet of the gas-liquid separation branch; and a fourth opening of the four-way valve is in communication with the first opening of the second heat exchanger;

wherein, the first opening of the four-way valve is in communication with the second opening of the four-way valve, and the third opening of the four-way valve is in communication with the fourth opening of the four-way valve; or the first opening of the four-way valve is in communication with the fourth opening of the four-way valve, and the second opening of the four-way valve is in communication with the third opening of the four-way valve.

8. The circulation system of the air conditioner according to claim 1, wherein, the first heat exchanger comprises a shell and tube heat exchanger, and/or the second heat exchanger comprises a finned heat exchanger.

9. The circulation system of the air conditioner according to claim 1, wherein, a first filter and a first one-way valve are provided between the refrigerant outlet of the heat exchange branch and the first opening of the first heat exchanger.

10. The circulation system of the air conditioner according to claim 1, wherein, a second filter and a second one-way valve are provided between the second opening of the second heat exchanger and the refrigerant inlet of the heat exchange branch.

11. The circulation system of the air conditioner according to claim 9, wherein, a third filter is provided between the first one-way valve and the first opening of the first heat exchanger.

12. The circulation system of the air conditioner according to claim 9, wherein, a fourth filter is provided between the second opening of the first heat exchanger and the refrigerant inlet of the gas-liquid separation branch, and the fourth filter is also disposed between the second opening of the first heat exchanger and a refrigerant outlet of the compressor.

13. The circulation system of the air conditioner according to claim 9, wherein, the first filter and a fourth one-way valve are provided between the refrigerant outlet of the heat exchange branch and the second opening of the second heat exchanger.

14. The circulation system of the air conditioner according to claim 9, wherein, an electronic expansion valve is further provided between the first filter and a fourth one-way valve, and the electronic expansion valve is also disposed between the first filter and the first one-way valve.

15. The circulation system of the air conditioner according to claim 11, wherein, the third filter and a third one-way valve are provided between the first opening of the first heat exchanger and the refrigerant inlet of the heat exchange branch.

16. The circulation system of the air conditioner according to claim 1, comprising a first operating mode and/or a second operating mode; wherein the first operating mode comprises a heating mode; and the second operating mode comprises a refrigerating mode and a defrosting mode.

17. The circulation system of the air conditioner according to claim 1, further comprising an oil return branch;

wherein an oil return branch inlet of the oil return branch is in communication with an oil return hole of the first heat exchanger; an oil return branch outlet of the oil return branch is connected to a preset position; the preset position is located in a flow path between a refrigerant outlet of one gas-liquid separator, which is in the gas-liquid separation assembly and located upstream of a flow direction of the refrigerant, and a refrigerant inlet of another gas-liquid separator, which is in the gas-liquid separation assembly and located downstream of a flow direction of the refrigerant.

* * * * *